US007210254B2

(12) United States Patent
Docker

(10) Patent No.: US 7,210,254 B2
(45) Date of Patent: May 1, 2007

(54) TROUSER PRESS/IRONING BOARD

(75) Inventor: George Docker, London (GB)

(73) Assignee: Sydon Solutions Limited (GB)

( * ) Notice: Subject to any disclaimer, the term of this patent is extended or adjusted under 35 U.S.C. 154(b) by 0 days.

(21) Appl. No.: 10/541,879

(22) PCT Filed: Dec. 17, 2003

(86) PCT No.: PCT/GB03/05522

§ 371 (c)(1),
(2), (4) Date: Jul. 8, 2005

(87) PCT Pub. No.: WO2004/063452

PCT Pub. Date: Jul. 29, 2004

(65) Prior Publication Data

US 2006/0107558 A1 May 25, 2006

(30) Foreign Application Priority Data

Jan. 10, 2003 (GB) ..... 0300631.9

(51) Int. Cl.
*D06F 81/02* (2006.01)
*D06F 81/08* (2006.01)

(52) U.S. Cl. ..... 38/104

(58) Field of Classification Search ..... 38/69, 38/70, 71, 72, 104, 139, 103; 219/245, 247, 219/259; 108/40, 47, 48; D32/66, 73
See application file for complete search history.

(56) References Cited

U.S. PATENT DOCUMENTS 3,145,490 A * 8/1964 Corby ..... 38/71
3,203,122 A * 8/1965 Sweatt ..... 38/104
3,430,370 A * 3/1969 Topliffe ..... 38/104
4,514,918 A * 5/1985 Warner ..... 38/36
4,536,978 A * 8/1985 Cerutti ..... 38/103
4,689,905 A * 9/1987 Vartan ..... 38/26
4,783,916 A 11/1988 Whitehead
5,290,998 A 3/1994 Couch et al.
5,359,792 A * 11/1994 Hanada et al. ..... 38/72
2002/0095827 A1 7/2002 Rosa

FOREIGN PATENT DOCUMENTS

| | | |
|---|---|---|
| EP | 0 328 727 A | 8/1989 |
| GB | 926 388 A | 5/1983 |
| JP | 06 000300 A | 4/1994 |

* cited by examiner

*Primary Examiner*—Ismael Izaguirre
(74) *Attorney, Agent, or Firm*—Carter, DeLuca, Farrell & Schmidt LLP

(57) ABSTRACT

A combined trouser press and ironing board assembly is disclosed. It comprises a heatable pad (14) against which a surface of a pressure plate (4) is clampable in a first position to sandwich a garment to be pressed therebetween. The pressure plate (4) is mounted by means which allow said plate (4) to be moved relative to the heatable pad (14) into a second ironing position in which the pressure plate (4) extends laterally outwardly relative to the heatable pad (14) so that the surface thereof which was facing the heatable pad (14) in its first position now provides the surface on which a garment can be placed for ironing.

23 Claims, 15 Drawing Sheets

TROUSER PRESS/IRONING BOARD

BACKGROUND OF THE INVENTION

1. Technical Field

This invention relates to an apparatus or assembly that can be used as a trouser press but is capable of conversion for use as an ironing board.

2. Description of Related Art

Trouser presses in which a pair of trousers can be sandwiched and clamped between a heated pad and a pressure plate are known. Ironing boards on which garments can be ironed are also known. However, this requires two separate pieces of equipment so there is a need for an apparatus that combines both of these functions into a single assembly.

It is also quite difficult to correctly position a pair of trousers in a conventional trouser press so that the creases are straight and in the correct place. It is therefore desirable to have a pressing apparatus that enables a pair of trousers or other garment to be positioned more easily prior to being pressed.

SUMMARY

According to the invention there is provided a combined trouser press and ironing board assembly comprising a heatable pad against which a surface of a pressure plate is clampable in a first pressing position to sandwich a garment to be pressed therebetween, the pressure plate being mounted by means that allow said plate to be moved relative to the heatable pad into a second ironing position in which the pressure plate extends laterally outwardly relative to the heatable pad such that the surface of the pressure plate facing the heatable pad in said first position now forms the surface on which a garment can be placed for ironing.

Preferably, the assembly includes a body housing the heatable pad and the pressure plate, one end of said pressure plate being pivotally attached to the body whereby sad plate can pivot about said one end towards and away from the heatable pad. In a preferred embodiment, the assembly includes a slide member at said end of the pressure plate and guide means adjacent to the heatable pad, the slide member and the guide means co-operating such that the slide member slides along the guide means when the pressure plate is moved into its second ironing position.

Conveniently, the guide means comprise a slot or channel along each side edge of the heatable pad in which the slide member is located.

Preferably, a support leg extends between the pressure plate and the body to support the pressure plate in said second ironing position. Conveniently, one end of said leg is pivotally attached to the body adjacent the base thereof, the opposite end of said leg being mounted on the pressure plate so as to be longitudinally slidable therealong.

A secondary stay is preferably pivotally attached at one end to the support leg intermediate the opposite ends thereof, the other end having a foot thereon, the secondary stay being received in a recess in the support leg and retained therein by a releasable catch. The pressure plate is preferably hollow with apertures in the surface on which garments are to be ironed, the hollow pressure plate communicating with extractor means housed in the body operable to draw steam generated during ironing away from the pressure plate.

Conveniently, the extractor means comprises a fan connected by ducting to the hollow interior of the pressure plate when said plate is in its second ironing position, the extractor means including a condenser unit to remove liquid from steam drawn out of the pressure plate by the extractor fan. Preferably, a water reservoir is housed within the body to collect condensate from the condenser unit.

Preferably, a pressurised steam boiler is housed within the body, said boiler being connected to a steam outlet to which a steam iron or brush can be connected. In the preferred embodiment, a duct connects the boiler with the water reservoir so that water can be fed thereto.

In one embodiment, the assembly includes a base plate on which to place the sole plate of the iron in a stowed position, the base plate having holes therein through which steam generated by the iron is drawn into the duct when the fan is in operation.

Advantageously, a valve member is mounted in the duct movable between a first position in which steam is drawn only from the pressure plate into the duct by the fan and a second position in which the steam is drawn only from the iron through the base plate into the duct by the fan, the valve member moving into said second position when the iron is placed on the base plate.

Preferably, the body has a pair of wheels rotatably mounted thereon. However, the assembly can also or alternatively include means for permanently mounting it on a vertical surface such as a wall.

In a preferred embodiment, the assembly includes a mechanism to assist a user move the pressure plate into the second position. Preferably, the mechanism includes a spring in the support leg having one end attached to the leg and the other end attached to the pressure plate via a flexible cord, the spring being held in tension by the cord when the pressure plate is in its first position such that, as the pressure plate is moved into its second position, the tension in the spring gradually reduces and helps the user draw the pressure plate into said second position.

BRIEF DESCRIPTION OF THE DRAWINGS

A preferred embodiment of the invention will now be described, by way of example only, with reference to the accompanying drawings, in which.

DETAILED DESCRIPTION OF EMBODIMENTS

Figure 1:
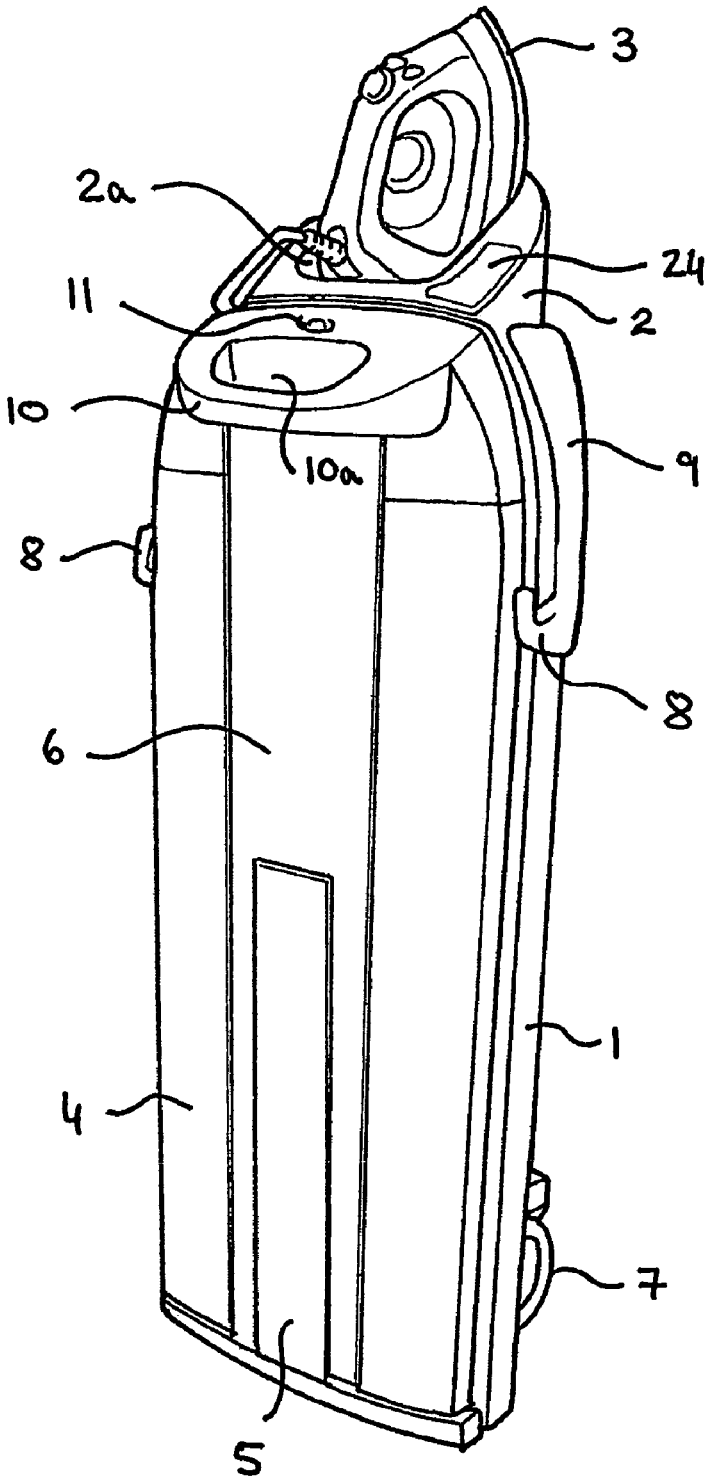
FIG. 1 is a front perspective view of a combined trouser press and ironing board of the present invention in its closed position.
Figure 2:
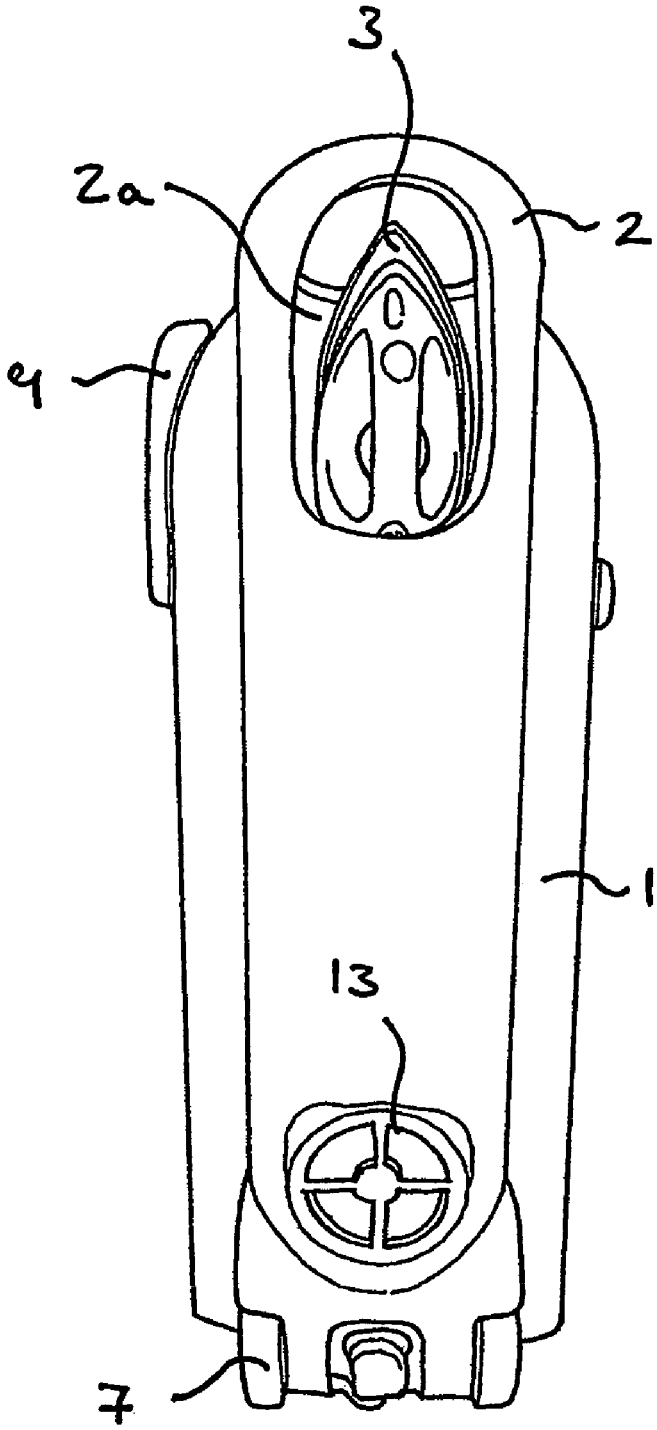
FIG. 2 is a rear view of the assembly shown in FIG. 1.

Referring to the drawings, there is shown a combined trouser press and ironing board apparatus/assembly comprising a moulded plastics body 1 having a top portion formed into a carrying handle 2. An iron 3 is stored in a cavity 2*a* formed in the top portion of the body 1.

Figure 3:
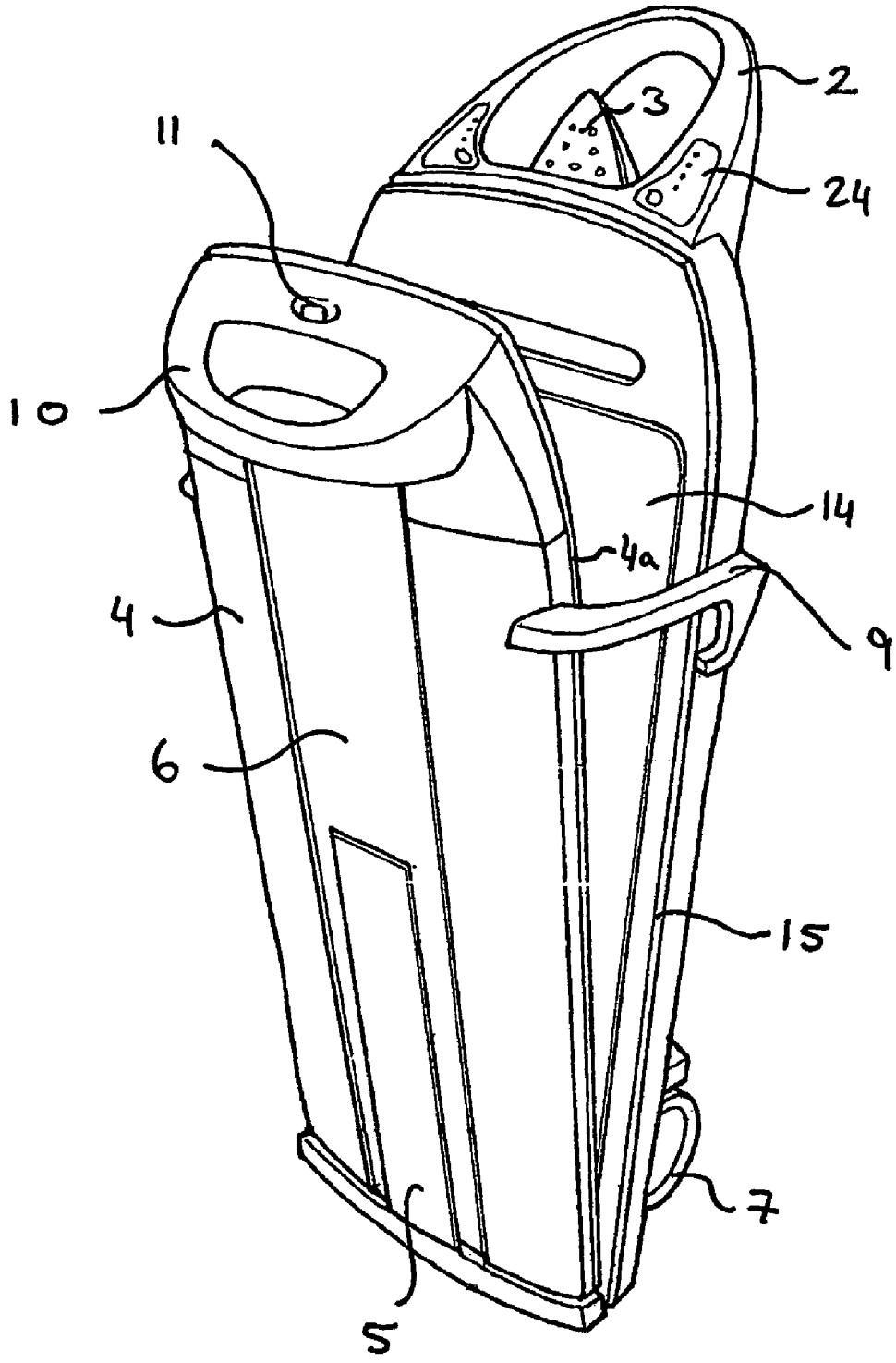
FIG. 3 shows the assembly of FIG. 1 in a first configuration for use as a trouser press.

The front of the assembly includes a pressure plate 4 that is hingedly attached at its base to the body 1 by means of a hinge assembly so that the pressure plate 4 can be pivoted outwardly away from the body 1 to provide access to heatable pad 14 as shown in FIG. 3. This allows a pair of trousers to be inserted between the pressure plate 4 and the heatable pad 14 so that the assembly can be used as a trouser press in this first configuration.

A stay 9 on one side of the body 1 limits pivotal movement of the pressure plate 4 away from the pad 14 and a pair of catches 8 on either side of the body 1 retain the pressure plate 4 in its closed position shown in FIG. 1.

Figure 5:
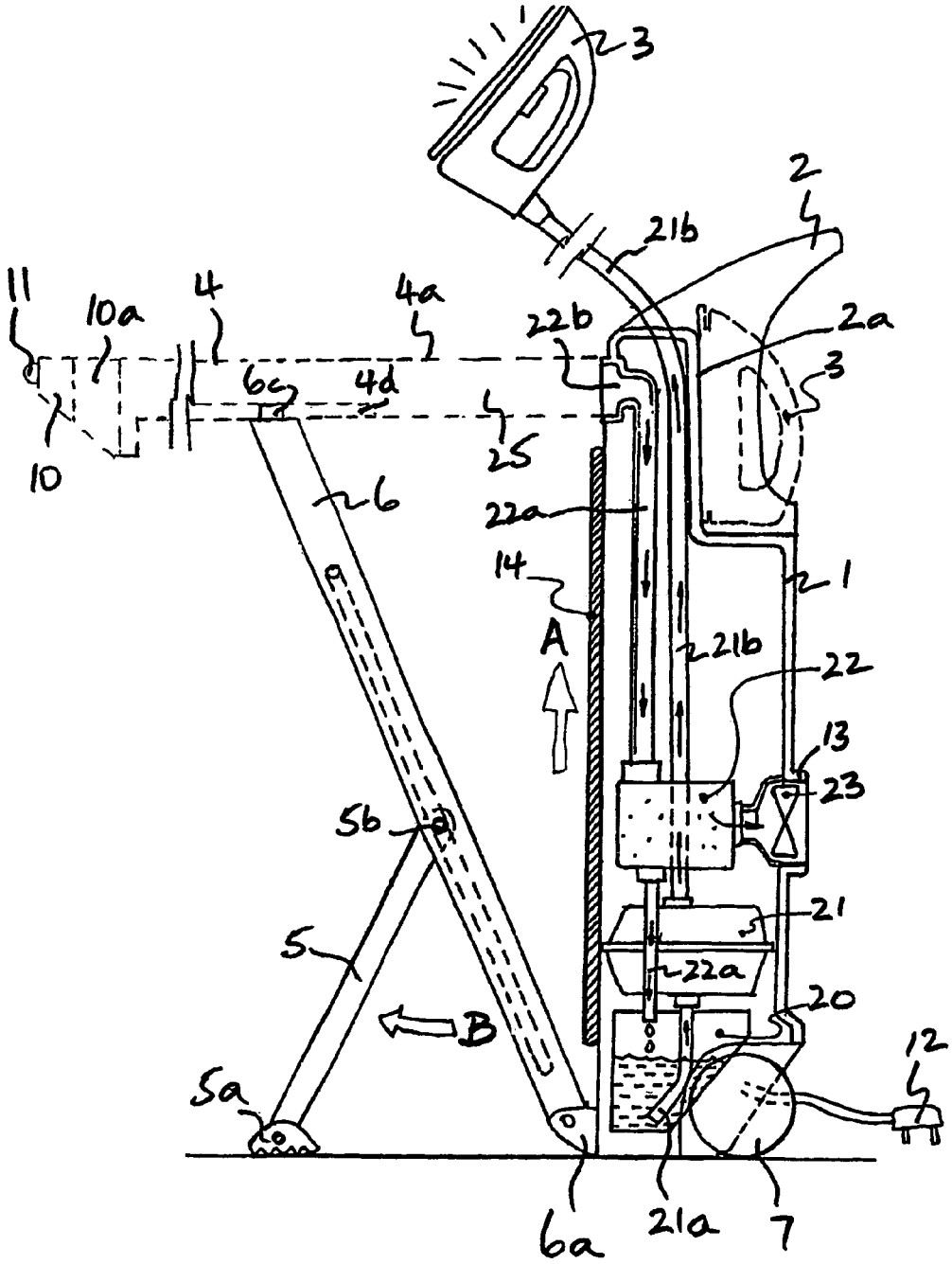
FIG. 5 is a schematic cross sectional view of the assembly shown in FIGS. 1–4.

A support leg 6 is mounted to the outside of the pressure plate 4 and includes a stay 5 pivotally attached thereto at 5*b*. Referring to FIG. 5, it can be seen that the bottom of leg 6 is attached at its base to the body 1 by means of pivot 6*a* and to the underside of the pressure plate 4 by means of a captive pin 6*c* slidably retained in a slot 4*d* extending along a part of the length of the pressure plate 4. The stay 5 has a stabiliser foot 5*a* pivotally attached to one end thereof, the opposite end being pivotally attached at 5*b* to the leg 6. The stay 5 is normally spring biased into its open position shown in FIG. 5 by spring means (not shown) and is retained in its stored position in a recess in the pressure plate 14 by means of a catch (not shown) releasable when button 11 at the distal end of said plate is depressed or when the pressure plate is pivoted forward from the position shown in FIG. 1 to the position shown in FIG. 3.

The free end of the pressure plate 14 has a handle 10 formed thereon on which the release button 11 for leg 6 is located.

A pair of wheels 7 is rotatably mounted to the base of the body to render the assembly mobile.

It will be noted from FIG. 5 that a novel feature of the assembly of the invention is the way in which the pressure plate 4 can be moved from its first trouser pressing position shown in FIGS. 1 and 3 to its second ironing position shown in FIG. 5. This is achieved by mounting the end of the plate 4 which is attached to the bottom of the body 1 to be slidably movable up the body until it reaches the position shown in FIGS. 4 and 5 where it extends laterally outwardly from the body 1 generally normal thereto. Plate 4 has a pair of pins or slide members 4*e* which extend laterally from each side of its base and are captively mounted to slide in a slot or channel 15 extending along either side edge of the plate 4 (see FIGS. 3 and 8E).

Figure 4:
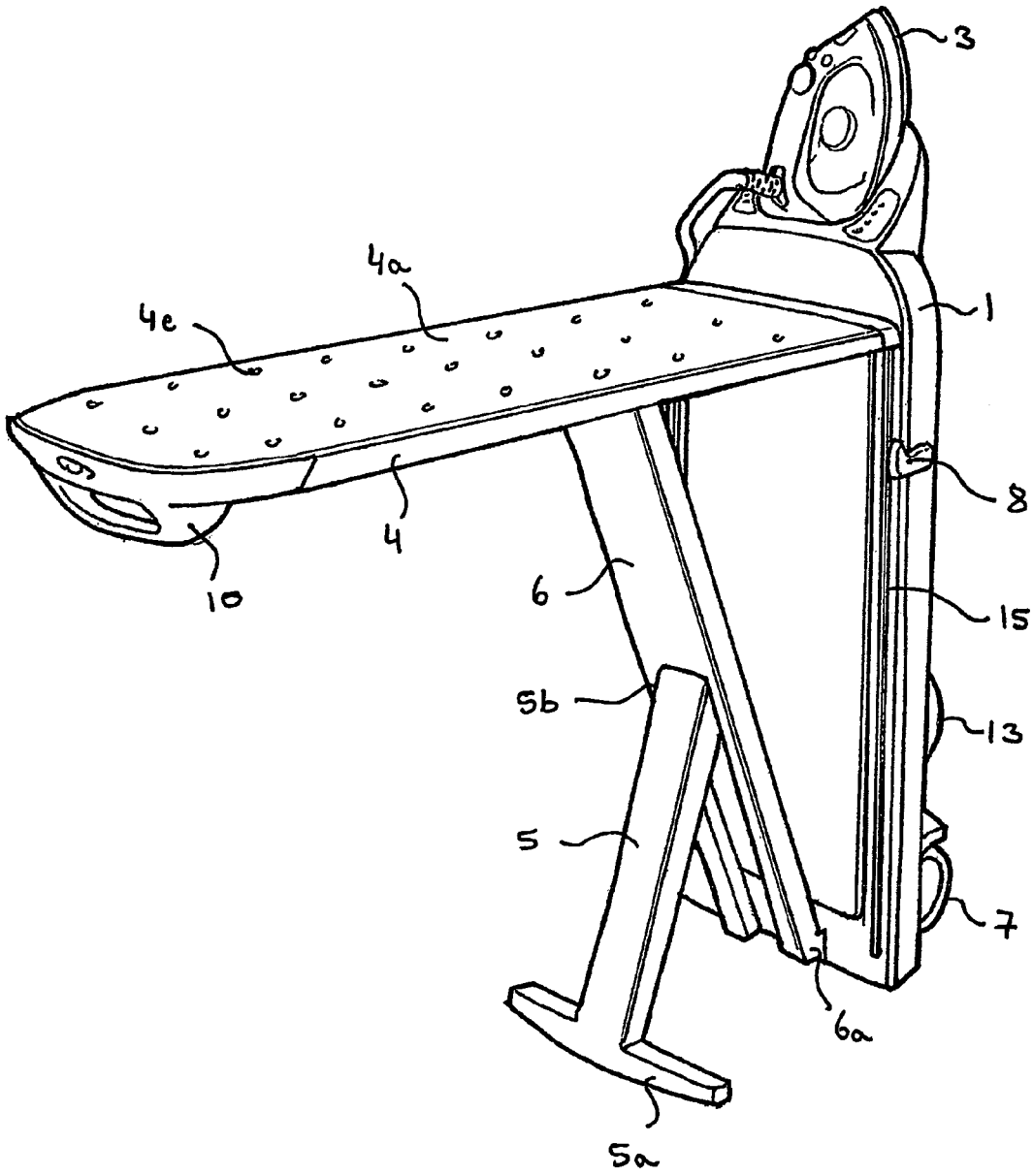
FIG. 4 shows the assembly of FIGS. 1–3 in a second configuration for use as an ironing board.

To convert the assembly from its trouser press mode shown in FIG. 3 to its ironing mode shown in FIGS. 4 and 5, the user releases the stay 9 from its position shown in FIG. 3 and then pulls the handle 10 horizontally outwardly and upwardly. This causes the hinge pins at the base of the plate 4 to slide upwardly in the slots 15 in the direction of arrow A thereby allowing the plate 4 to move upwardly and outwardly until the hinge pins reach the top end of the slots 15. The plate 4 would then be in its horizontal position shown in FIGS. 4 and 5 ready to be used as an ironing board.

Other features of the preferred trouser press/ironing board assembly shown in the drawings will now be described with reference to FIG. 5. First of all, it should be noted that the pressure plate 4, which also forms the ironing board, has a hollow interior 25 and its top surface 4*a* has a series of holes 4*e* formed therein for reasons that will be explained hereafter.

The body 1 houses a condenser 22 connected by a duct 22*a* to an inlet port 22*b* located at the top of the body 1 opposite the base of the pressure plate 4 when it is in its raised ironing position. A water outlet duct 22*c* extends from the bottom of the condenser 22 and discharges condensate into a reservoir 20 located beneath it in the base of the body 1. The condenser 22 has an air outlet 13 with a fan 23 mounted therein.

Steam iron 3 is connected by flexible tube 21*b* to steam boiler 21 mounted in the body 1, the steam boiler drawing water from reservoir 20 via inlet duct 21*a*. The boiler 21 has an electrical heater (not shown) of known type therein. Electrical power to the assembly and the various electrical components therein is provided by retractable power cable 12 located in the base thereof.

The heatable pad 14 is of known type and comprises a planar surface with heating elements therein so no further description thereof will be given here.

The operation of the combined trouser press and ironing board assembly just described is as follows. If the assembly is to be used as a trouser press, the user will release the side catches 8 and pivot the pressure plate 4 outwardly about the bottom thereof into the position shown in FIG. 3. The stay 9 would then be lowered into position to restrict further outward pivotal movement. The user can then insert the garment to be pressed (usually a pair of trousers) into the assembly between the heatable pad 14 and the pressure plate 4. The pressure plate 4 is then pivoted towards the heatable pad 4 until it reaches its trouser pressing position shown in FIG. 1 and the side catches 8 are then re-engaged to retain the plate 4 firmly against the pad 14 and sandwich the garment therebetween. A switch on control panel 24 can then be activated to switch on the heaters in the pad 4, said heaters being thermostatically and time controlled and including a safety cut-out in known manner. Once the trouser-pressing phase is complete after a preselected time, the heaters are automatically switched off and a light on the control panel 24 illuminates to show that the cycle is complete. Alternatively, an audio signal such as a buzzer can be used. The user then releases the side catches 8 and pulls the pressure plate 4 outwardly using the handle 10, pivotal outward movement being limited by the stay 9. The pressed garment can then be removed.

If the user now wants to iron a garment, the stay 9 needs to be released from engagement with plate 14 and the user then pulls outwardly and upwardly on the handle 10 at its distal end thereby causing the base of the pressure plate 4 to slide upwardly in the slots 15 on either side of the heatable pad 14 until it reaches the position shown in FIG. 4. At the same time, the leg 6 will pivot outwardly in the direction of arrow B and pin 6*c* will slide along slot 4*a* in the underside of the plate 4 away from the handle 10 and towards the body 1 until it reaches the position shown in FIGS. 4 and 5 where it supports the plate 4 in a horizontal position. Pressing the button 11 then allows the stay 5 to spring out from the leg 6 and assume its position shown in FIGS. 4 and 5.

It should be noted that surface 4*a* of the pressure plate 4, which was originally facing the heatable pad 14, is now the top surface of the pressure plate and therefore the surface on which ironing can take place. A particular advantage of this arrangement is that trousers or another garment to be pressed can be placed on the pressure plate 4 whilst it is in its position ready for ironing and then the pressure plate 4 can be slid back into its trouser pressing orientation with the trousers still on the pressure plate 4. Accurate positioning of the trousers so that creases are pressed into the trousers in the correct place is made significantly easier as the trousers are laid flat on the pressure plate 4. Furthermore, the user may want to pre-iron the trousers prior to pressing them and this can be achieved without needing to re-position them ready for insertion into the press.

Figure 6:
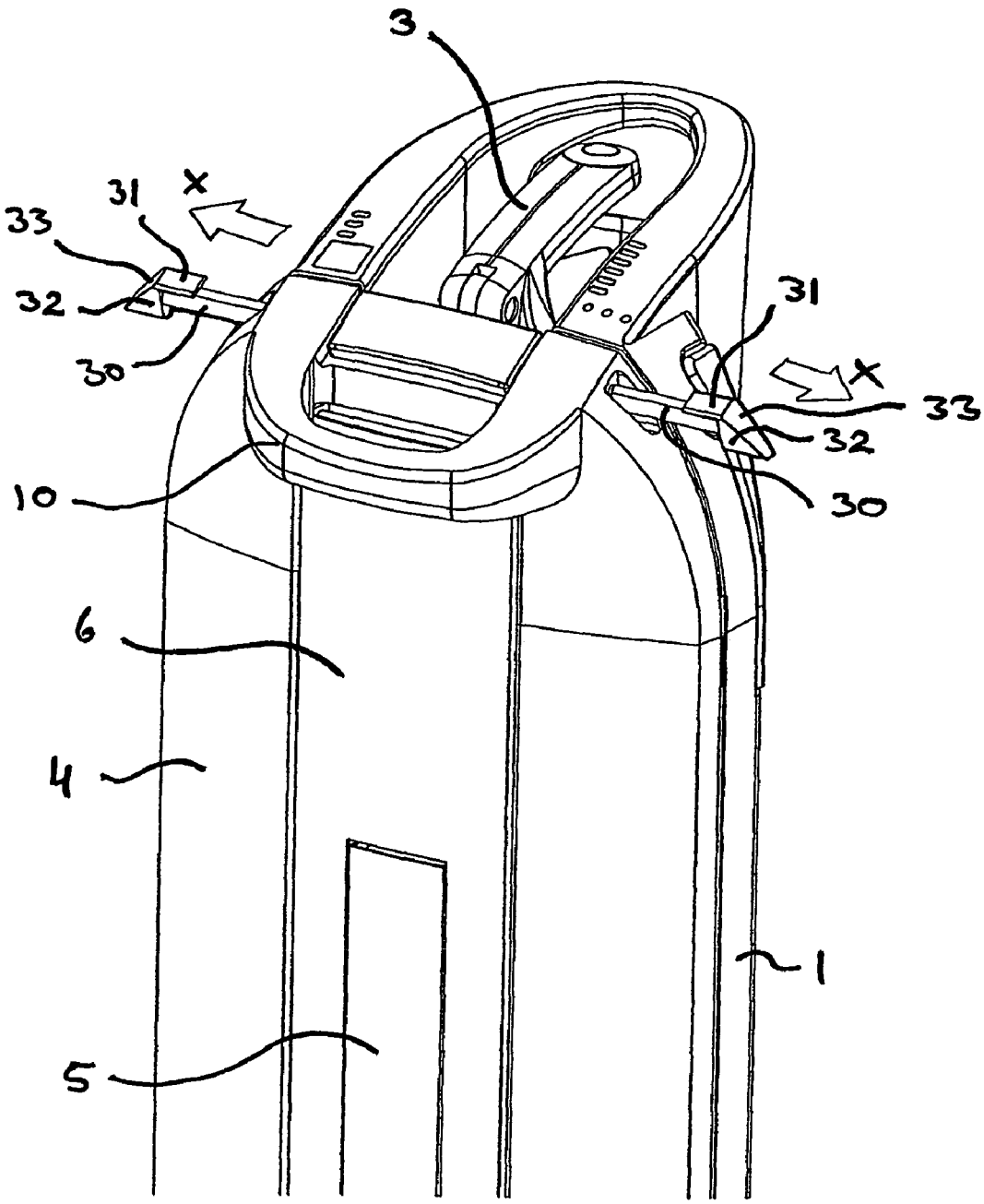
FIG. 6 is a perspective view of a top portion of a second embodiment of a combined trouser press and ironing board according to the invention.

To maintain the trousers in position prior to pressing and whilst moving the pressure plate 4 from the ironing to the pressing position, the pressure plate 4 may be provided with a pair of retractable sliding arms 30 which each extend laterally from the pressure plate 4 adjacent to its uppermost edge, as shown in the second embodiment of FIG. 6. A clip 31 is mounted on the end of each arm comprising a pair of co-operating sprung jaws 32 into which may be inserted, for example, the waistband of a pair of trousers. These clips 31 stabilise the garment on the pressure plate 4 and prevent it from dropping when the plate 4 is pivoted into the pressing position or moved from its ironing to the pressing position. Preferably, the arms 30 are sprung so that they pop out of the pressure plate 4, in the direction of arrow X in FIG. 6, when released and retract against a bias provided by a spring (not shown) when pushed back into the pressure plate 4. The outer surface 33 of each clip 31 may be shaped so as to correspond to the contour of the pressure plate 4 so that they fit flush with the pressure plate 4 when not in use.

In use, garments to be ironed are placed on the top surface 4*a* of the pressure plate 4 after the pressure plate 4 has been moved into its ironing position, as shown in FIG. 4 or 5, and ironed using a steam iron 3 that is supplied with steam from the boiler 21. Any steam, which passes through the garment, enters the cavity 25 inside the pressure plate 4 through the holes 4*c* and is drawn by fan 23 through the inlet 22*b* and duct 22*a* into the condenser 22 where condensate is removed and fed by pipe 22*a* into reservoir 20. Air free of water vapour exits the body 1 via outlet 13.

Figure 7A:
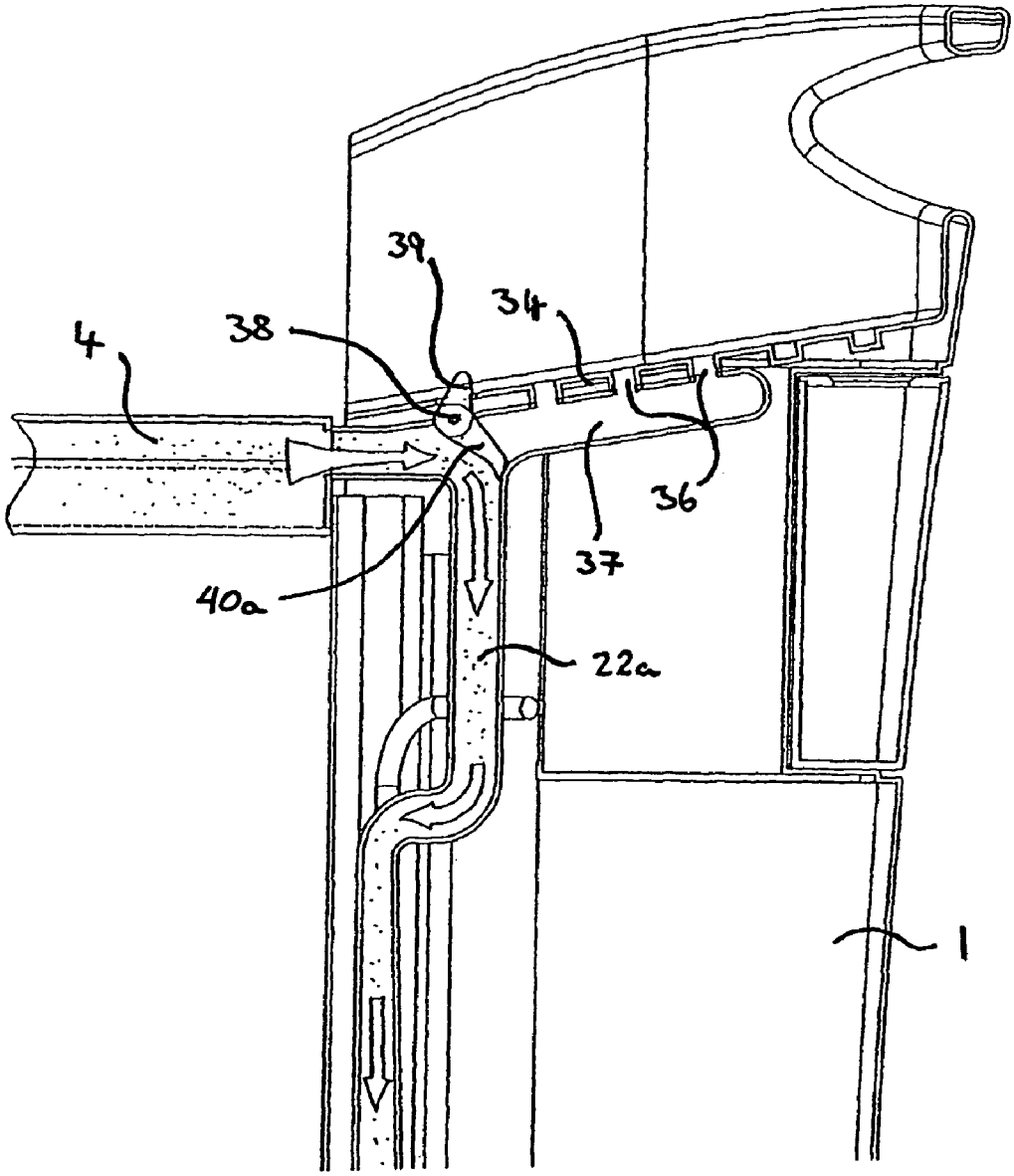
FIGS. 7A and 7B are side sectional views of a top portion of the combined trouser press and ironing board shown in FIG. 6 showing first and second positions of a valve member for drawing steam away from the pressure plate it is second ironing position when the iron is removed from a base plate and, from the base plate when the iron is stowed, respectively.
Figure 7B:
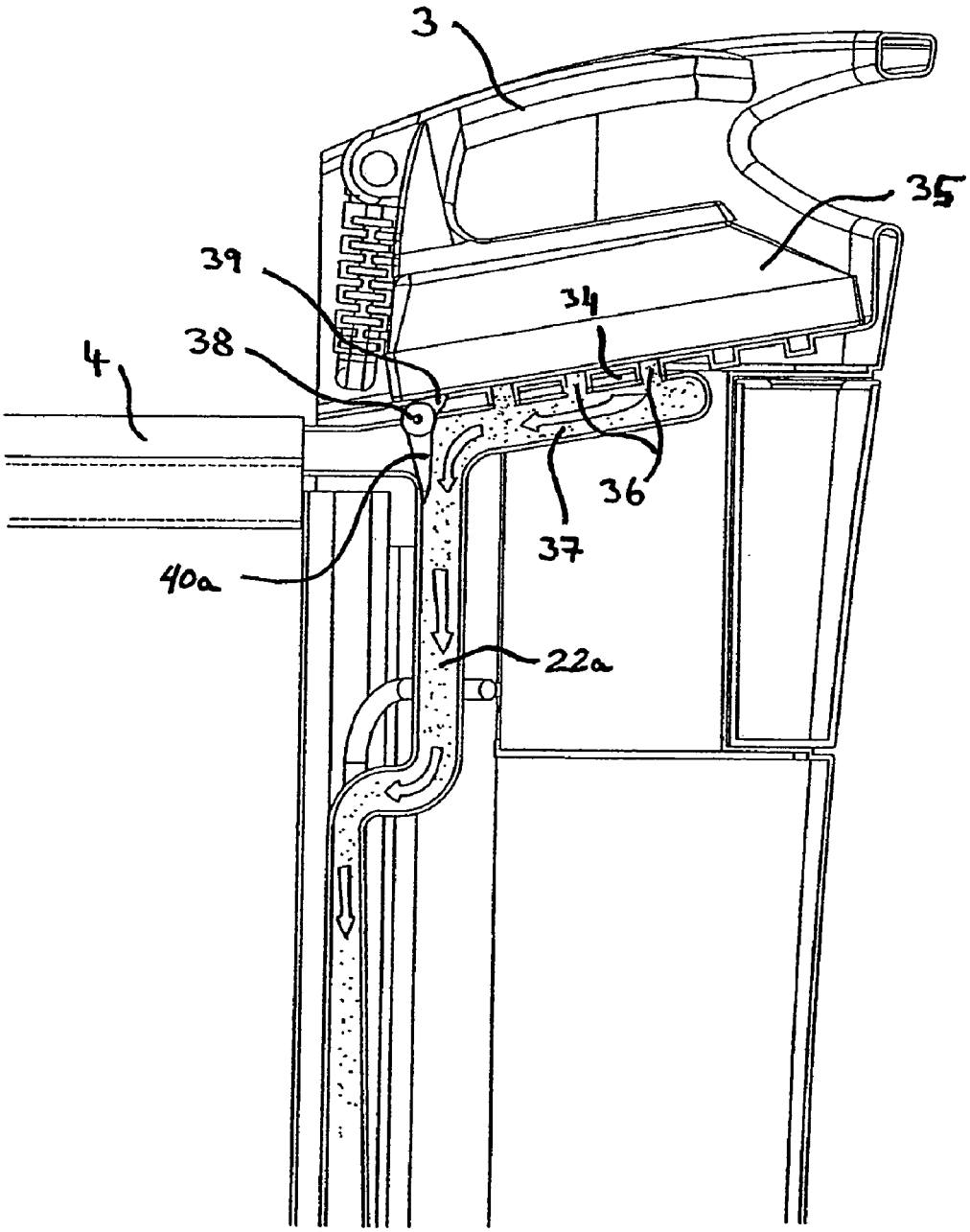

The second embodiment illustrated in FIGS. 7A and 7B works in the same way except that the housing 1 includes a perforated base plate 34. The sole plate 35 of the iron 3 is placed on the base plate 34 to stow it when not in use. The perforations 36 in the base plate 34 are in communication with an extension 37 of the duct 22*a* that extends beneath the base plate 34 and joins the duct 22*a*. A rotatably mounted valve member 38 is mounted within the duct 22*a* in the region where the extension 37 joins the remainder of the duct 22*a*. The valve member 38 includes a trigger 39 that protrudes through the base plate 34 and a baffle 40*a* that depends into the duct 22*a*. The valve member 38 is sprung or weighted so that it assumes the position shown in FIG. 7A when the iron 3 is removed from the base plate 34 so that the baffle 40*a* blocks the entrance to the extension 37 but allows steam drawn through the pressure plate 4 to pass through the duct 22*a* into the condenser 22 when the fan 23 is operational. However, when the iron 3 is placed on the base plate 34, its weight presses against the trigger 39 and causes the valve member 38 to rotate into the orientation shown in FIG. 8 so that the baffle 40*a* now blocks the path of the duct 22*a* from the pressure plate 4 and communicates the extension 37 with the remainder of the duct 22*a*. As can be seen from the arrows in FIG. 7A, this arrangement ensures that any steam generated by the iron 3 whilst it is placed on its base plate 34 is drawn away through the perforations 36 and into the condenser 22 via the duct 22*a*.

Figure 8A:
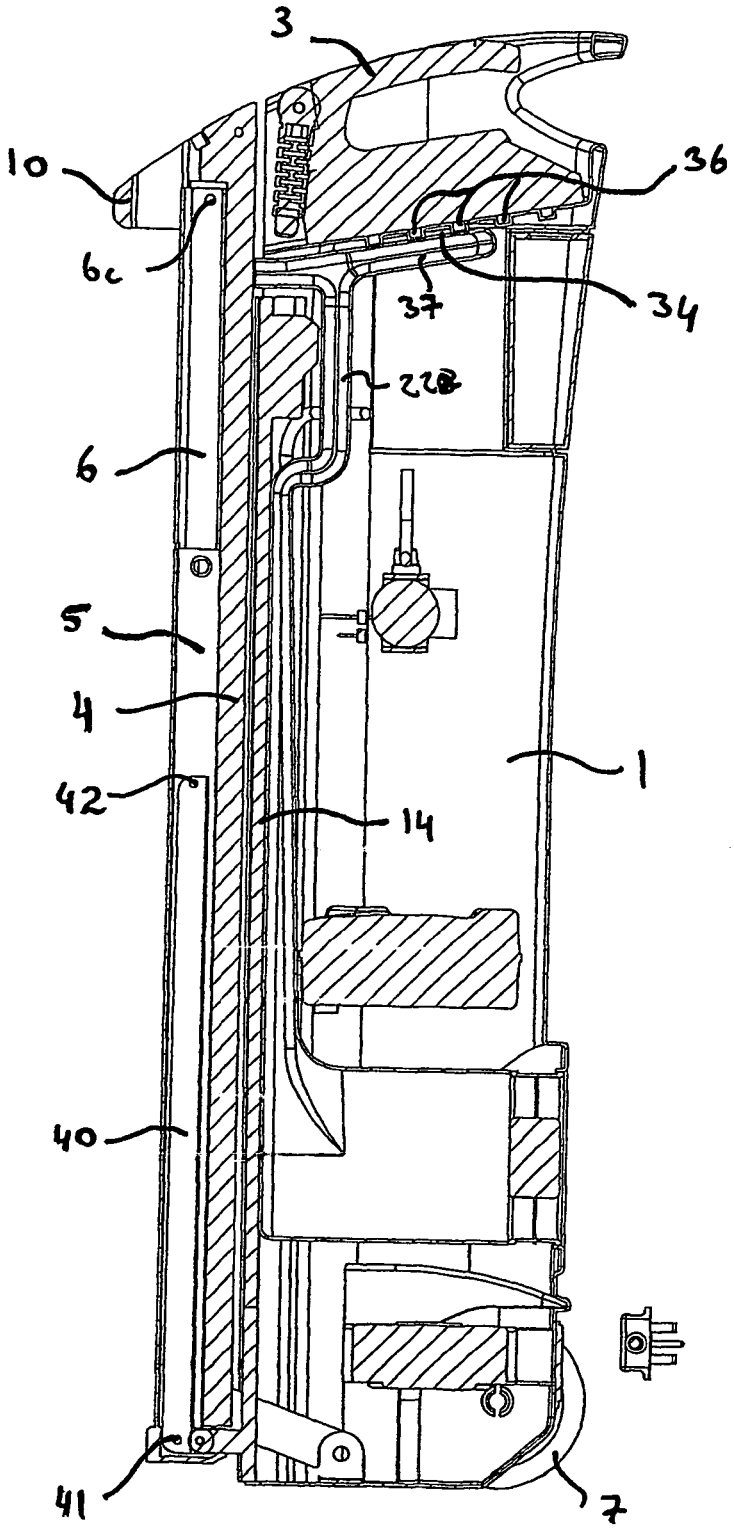
FIG. 8A is a side sectional view of the assembly shown in FIGS. 6 and 7 with the pressure plate in its clamped position against the heatable pad.
Figure 8B:
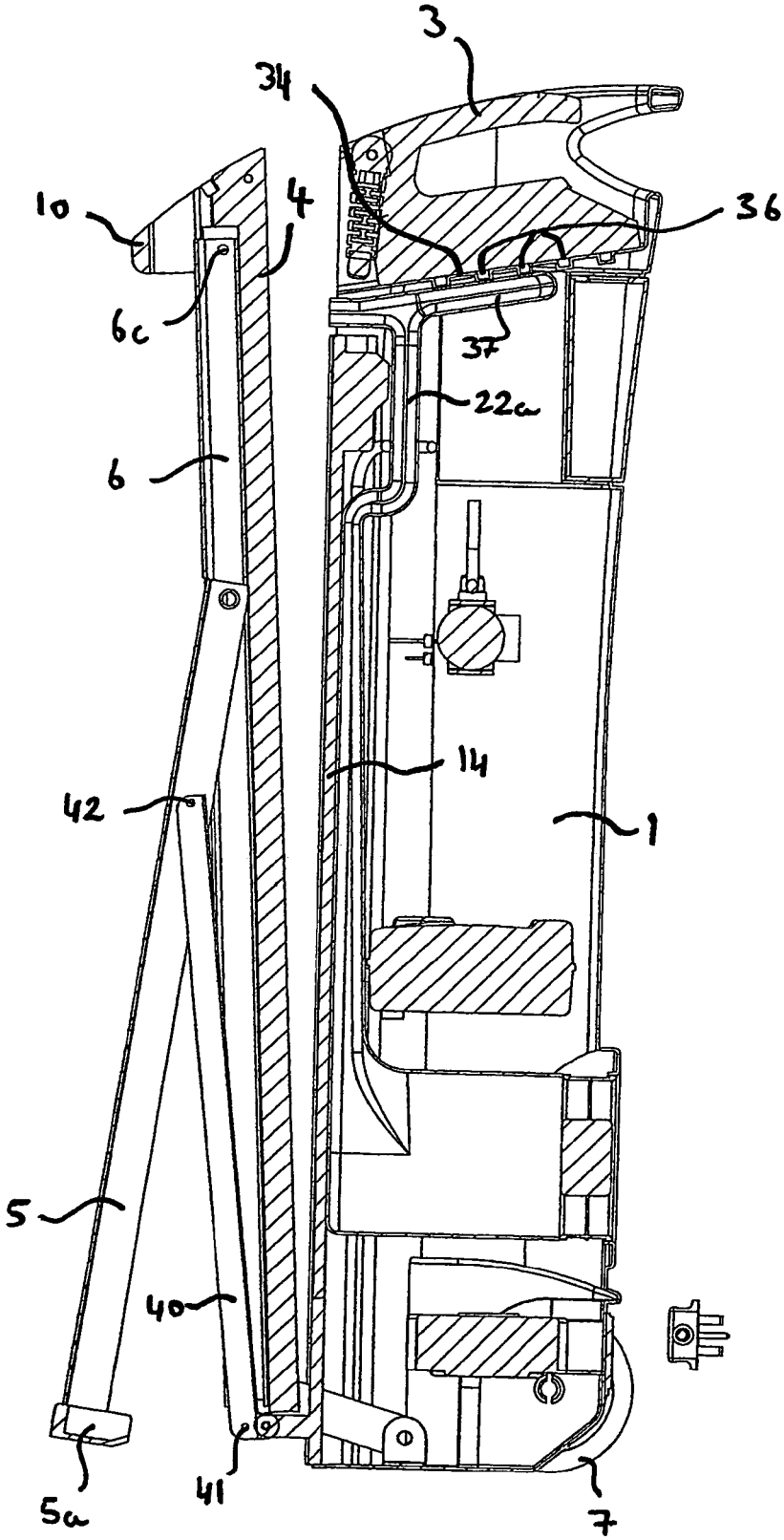
FIGS. 8B and 8C show the same side sectional view of FIG. 8A with the pressure plate partially and fully pivoted away from the heatable pad and the stay in its supporting position.

As described above in connection with the first embodiment, the support leg 6 includes a stay 5 pivotally attached thereto. In a modified arrangement shown in FIGS. 8A to 8E, the stay 5 and leg 6 are connected by a secondary linking member 40 pivotally attached to the housing 1 and the stay 5 at each end at lower and upper pivot points 41,42 respectively. The upper pivot point 42 is located in a short elongate slot 43 in the stay so that the upper pivot point 42 can slide in the slot 43 as the stay 5 pivots outwardly from its stowed position shown in FIG. 8A to its extended position shown in FIG. 8C. In a preferred arrangement, the stay 6 is sprung so that it automatically pops out from its stowed position in the leg 6 when the pressure plate 4 is moved from its position shown in FIG. 8A to the position shown in FIG. 8C. As the pressure plate 4 is supported in the position shown in FIG. 8C by the stay 5, the stay 9 showed in FIG. 3 is no longer required. However, clamping means for pressing the pressure plate 4 against the heatable pad when the pressure plate 4 is in the position shown in FIG. 8A is still needed.

To move the pressure plate 4 from the open trouser press position illustrated in FIG. 8C to the second ironing position shown in FIG. 8E, the user has to lift and pull the pressure plate 4 so that the slide members on the pressure plate 4 slide upwardly along the channel 15 adjacent to the heatable pad 14 and the pin 6*c* slides along slot 4*a* in the underside of the pressure plate 4, as previously described with reference to FIGS. 4 and 5. Referring now to FIGS. 9A and 9B, the assembly may include a pulley mechanism to assist the user in moving the pressure plate 4 from the first to the second position and back again. The mechanism includes a spring 44 disposed within the leg 6 having one lower end attached to a fixed point 45 on the leg 6. A flexible cord 46 having one end attached to the pin 6*c* at the top of the leg 6 and along which the pressure plate slides extends towards and loops through a ring 48 at the other end of the spring and runs back over the pin 6*c*. The end of the cord 46 extends substantially the length of the pressure plate and is connected to another fixed point 49 on the pressure plate 4. The spring 44 is held in tension by the cord 46 when the pressure plate 4 is in the position shown in FIG. 8C.

Operation of the mechanism will now be described. When the pressure plate 4 is to be moved from the position shown in FIG. 9A to the ironing position shown in FIG. 8E, the user pulls and lifts the handle 10. During this movement, the distance between the pin 6*c* and the fixed-point 49 decreases. As it does so, the portion of the cord 46 extending between the fixed point 49 and the pin 6*c* shortens and thereby releases the tension in the spring 44 which relieves the user of a at least a portion of the weight of the pressing plate 4. The spring 44 effectively helps to pull the board into the second ironing position.

Figure 8C:
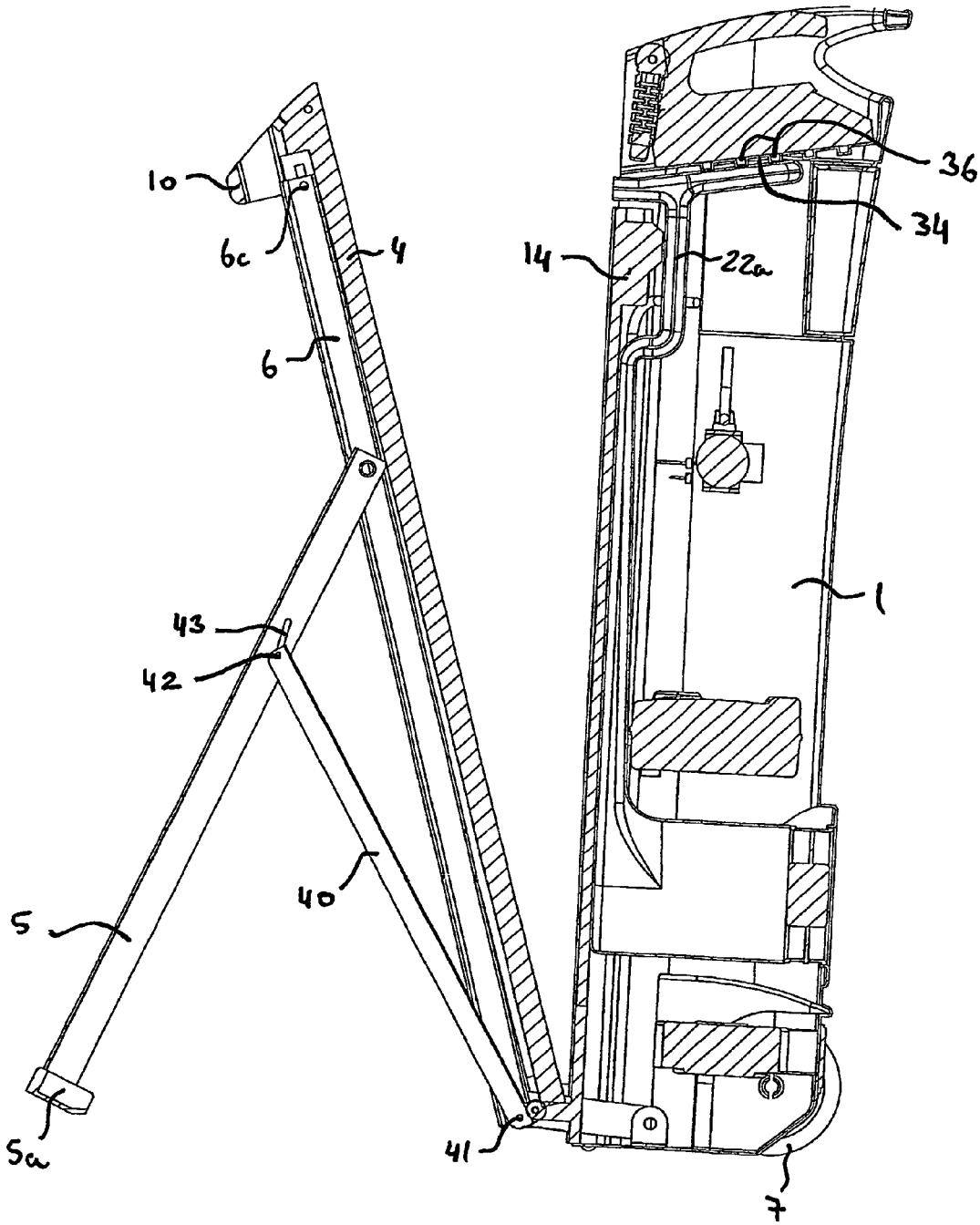
Figure 8D:
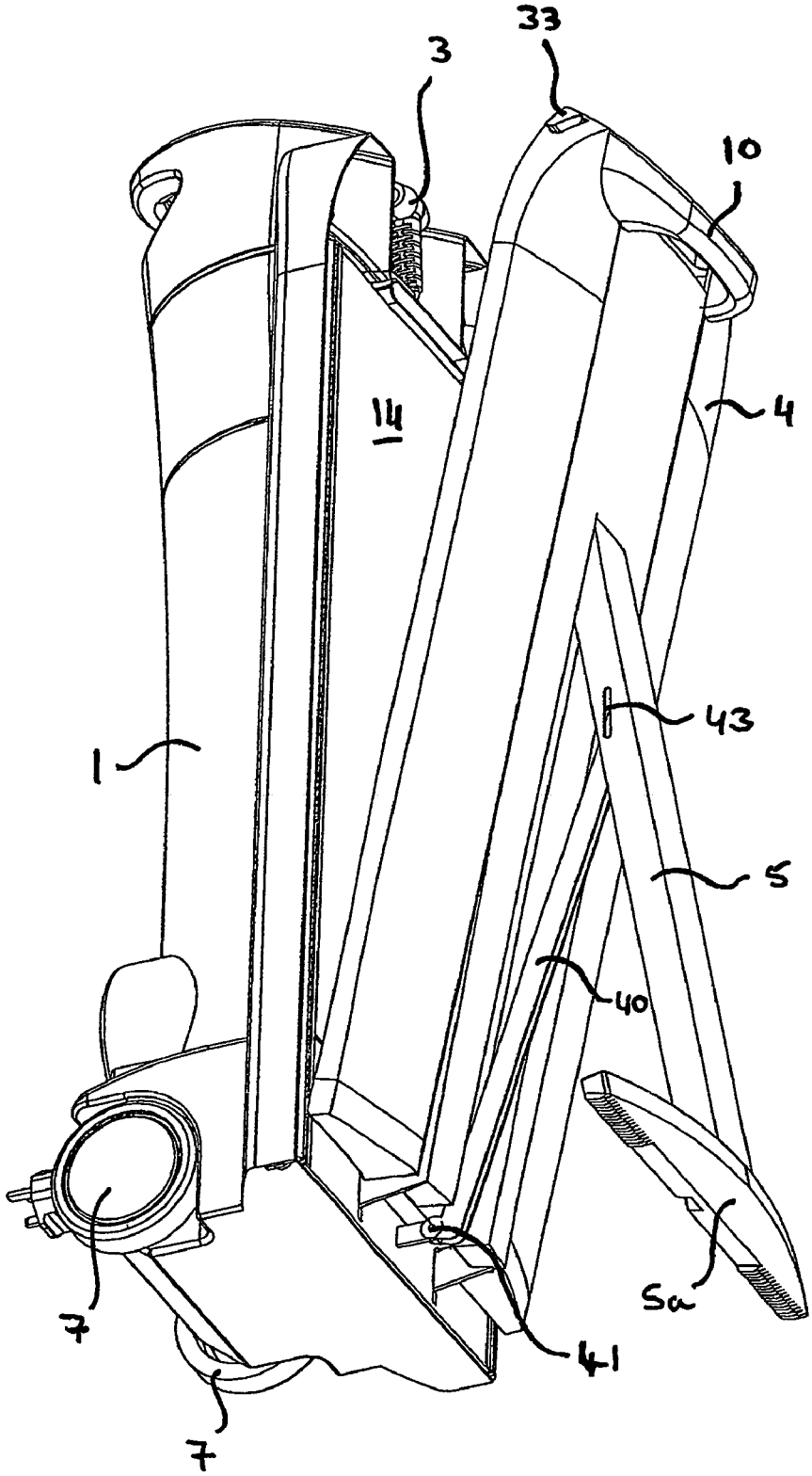
FIG. 8D is an underside perspective view of the assembly shown in FIG. 8A.
Figure 8E:
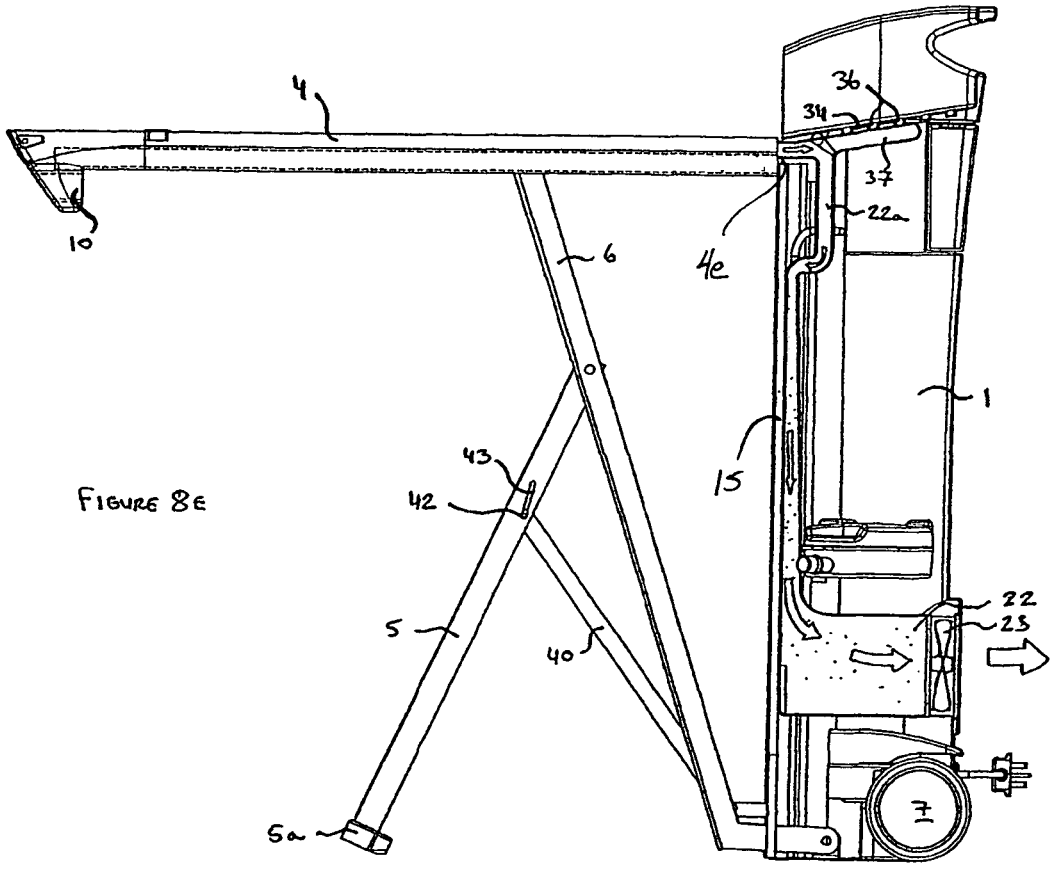
FIG. 8E is another side sectional view of the assembly shown in FIG. 8 with the pressure plate in its second ironing position.
Figure 9A:
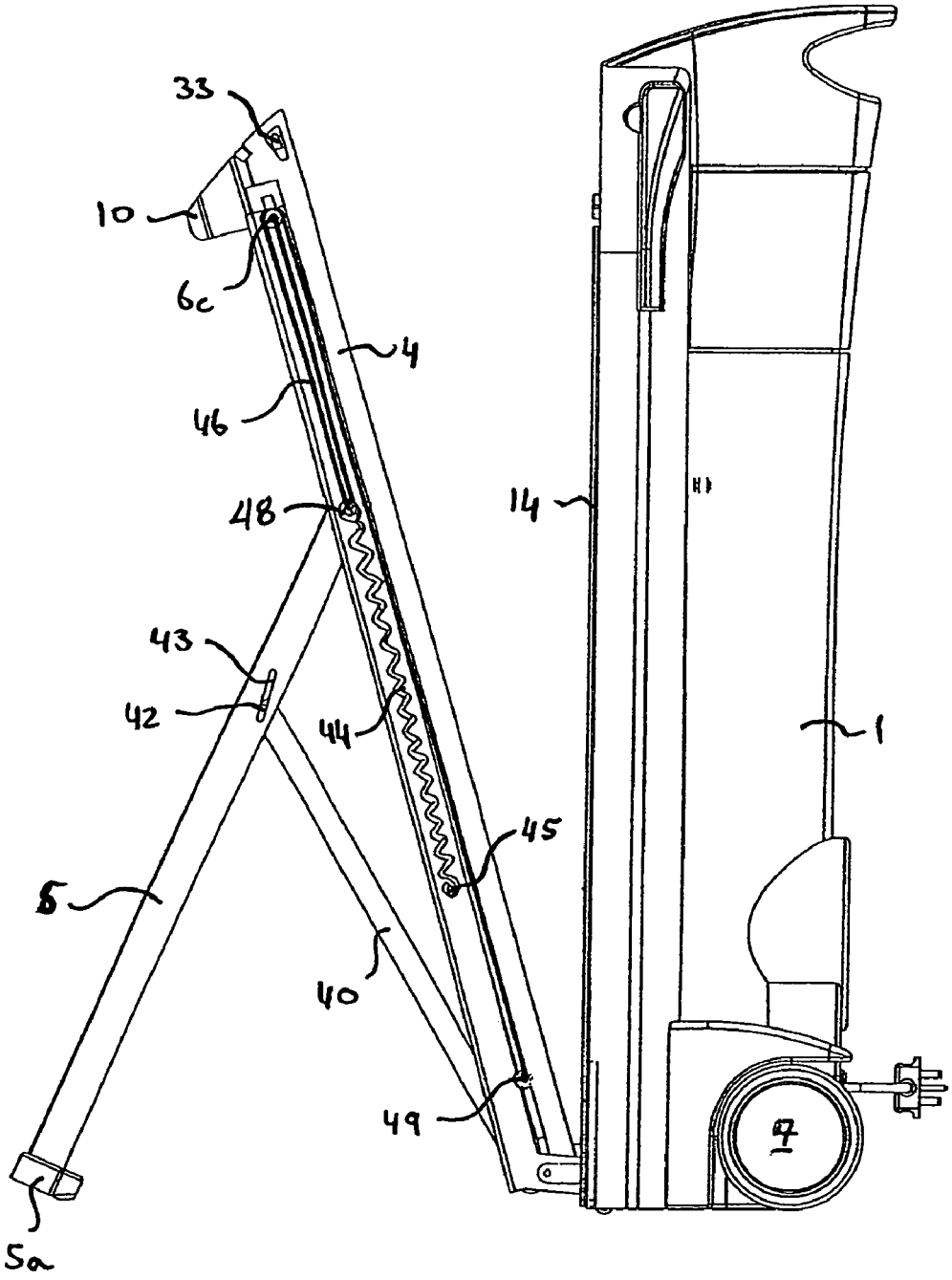
FIG. 9A is the same as FIG. 8C except that only a portion of the leg is shown in section so that the mechanism for assisting a user to move the pressure plate from its first to its second ironing position can be seen.
Figure 9B:
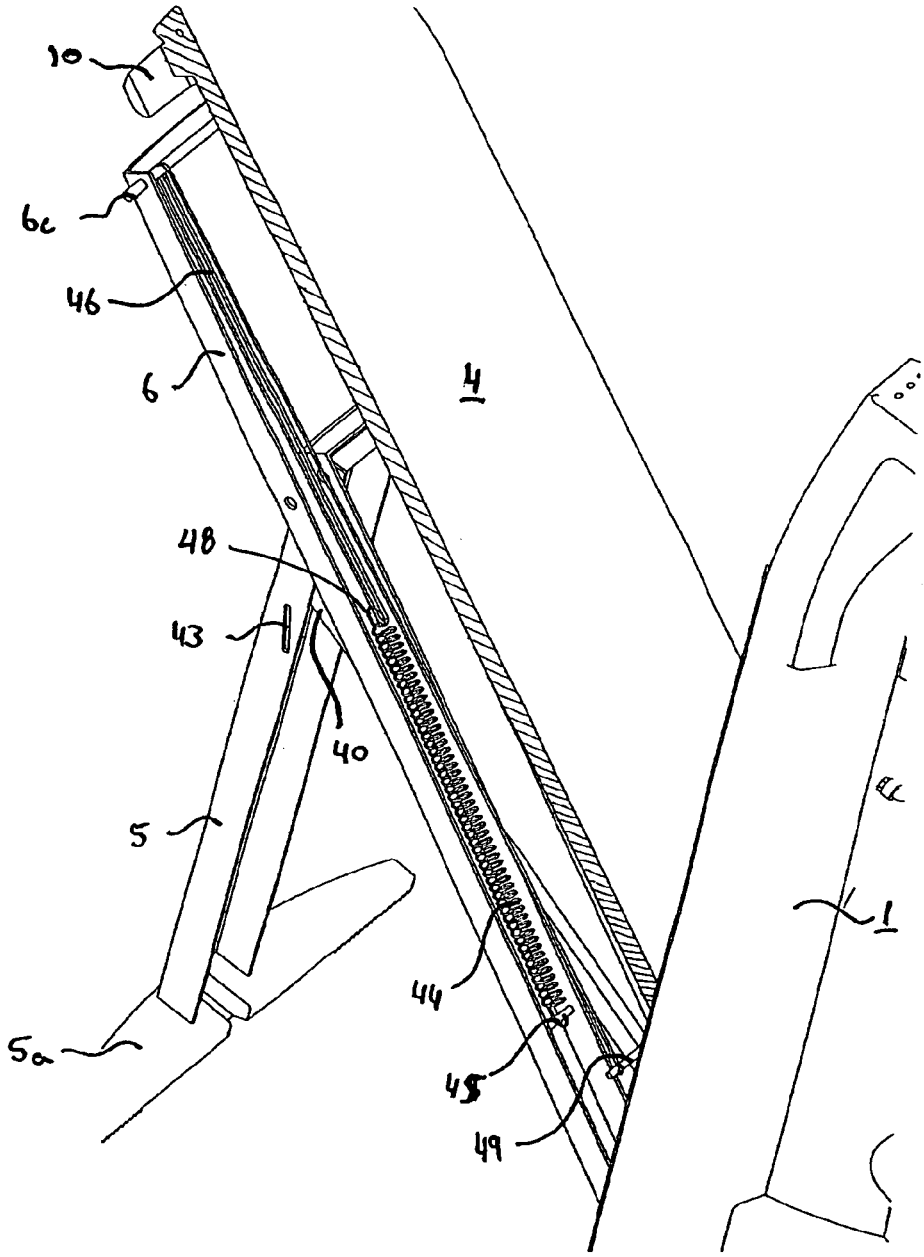
FIG. 9B is a perspective view of part of the assembly shown in FIGS. 8 and 9 with a portion of the pressure plate removed so that the mechanism for assisting a user to move the pressure plate from its first to its second ironing position can be seen.

When the board is to be returned to the position shown in FIG. 8C from the ironing position shown in FIG. 8D, the user lifts and pushes on the handle 10. As the pressure plate 4 slides back down, the spring 44 becomes tensioned once again and provides resistance against the movement of the pressure plate 4. The spring 44 can be selected to provide a resistance which is no greater than the weight of the board so that the board feels "weightless" as it is moved between its first position and the ironing position and prevents the pressure plate 4 from dropping back into its first position under its own weight if it is released by the user during this movement.

It will be apparent that the present invention provides an assembly incorporating both a trouser press and an ironing board which is simple and easy to use and which can be converted between its pressing and ironing positions quickly and easily. As the surface on which garments are ironed also forms the pressure plate for the press which is clamped against a heatable pad, garments can be positioned on the pressure plate when it is in its ironing position and remain in place whilst it is moved into its pressing position.

The invention claimed is:

1. A combined trouser press and ironing board assembly, comprising:

a heatable pad housed in a body;

a pressure plate, a surface of which is clampable against the heatable pad in a first position to sandwich a garment to be pressed therebetween, one end of the pressure plate being pivotally attached to the body to allow said plate to pivot about said one end towards and away from the heatable pad into a second position for ironing in which the pressure plate extends laterally outwardly relative to the heatable pad and the surface of the pressure plate, which was facing the heatable pad in said first position, now defines a surface on which a garment is placed for ironing;

a slide member disposed at said one end of the pressure plate; and guide means in the body adjacent to the heatable pad, the slide member and guide means co-operating such that the slide member slides along the guide means when the pressure plate is moved relative to the heatable pad between said first and second positions.

2. An assembly as claimed in claim 1, wherein the assembly includes a body housing the heatable pad and the pressure plate, wherein one end of said pressure plate is pivotally attached to the body whereby said plate can pivot about said one end towards and away from the heatable pad.

3. An assembly as claimed in claim 2, wherein the guide means are configured and adapted to allow said one end of the pressure plate to slide along opposite side edges of the heatable pad so that the pressure plate is movable into said second ironing position.

4. An assembly as claimed in claim 3, wherein said guide means comprises a slot along each side edge of the heatable pad.

5. An assembly as claimed in claim 4, further comprising a support leg extending between the pressure plate and the body to support the pressure plate in said second ironing position.

6. An assembly as claimed in claim 5, wherein one end of said support leg is pivotally attached to the body adjacent a base thereof, an opposite end of said support leg being slidably mounted in an underside of the pressure plate in such a manner for longitudinal sliding therealong.

7. An assembly as claimed in claim 6, further comprising a secondary stay pivotally attached at one end to the support leg, intermediate the opposite ends thereof, the other end of the secondary stay having a foot thereon.

8. An assembly as claimed in claim 7, wherein said secondary stay is received in a recess in the support leg.

9. An assembly as claimed in claim 8, wherein a secondary linking member extends between the housing and the stay.

10. An assembly as claimed in claim 9, comprising a mechanism for assisting a user to move the pressure plate into the second position.

11. An assembly according to claim 10, wherein the mechanism includes a spring in the support leg having one end attached to the support leg and the other end attached to the pressure plate via a flexible cord, the spring being held in tension by the cord when the pressure plate is in its first position such that, as the pressure plate is moved into the second position, the tension in the spring gradually reduces and helps the user draw the pressure plate into said second position.

12. An assembly as claimed in claim 11, wherein the pressure plate is hollow and includes a plurality of apertures in a surface on which garments are to be ironed.

13. An assembly as claimed in claim 12, wherein the hollow pressure plate communicates with extractor means housed in the body, the extractor means being operable to draw steam generated during ironing from the hollow interior of the pressure plate.

14. An assembly as claimed in claim 13, wherein the extractor means comprises a fan connected by ducting to the hollow interior of the pressure plate when said plate is in its second ironing position.

15. An assembly as claimed in claim 14, including a base plate on which to place a sole plate of an iron in a stowed position, the base plate having holes formed therein through which steam generated by the iron is drawn into a duct when the fan is in operation.

16. An assembly as claimed in claim 15, including a valve member in the duct, the valve being movable between a first position in which steam is drawn only from the pressure plate into the duct by the fan and a second position in which the steam is drawn only from the iron through the base plate into the duct by the fan, the valve member moving into said second position when the iron is placed on the base plate.

17. An assembly as claimed in claim 16, wherein the extractor means includes a condenser unit to remove liquid from steam drawn into the duct by the fan.

18. An assembly as claimed in claim 17, further comprising a water reservoir housed within the body to collect condensate from the condenser unit.

19. An assembly as claimed in claim 18, further comprising a pressurized steam boiler housed within the body, said boiler being connected to a steam outlet to which at least one of a steam iron and a brush is connected.

20. An assembly as claimed in claim 19, wherein a duct connects the water reservoir with the boiler.

21. An assembly according to claim 20, wherein the pressure plate includes a pair of laterally extending retractable arms having clips at the ends thereof for gripping garments placed on the pressure plate.

22. An assembly as claimed in claim 21, wherein the body has a pair of wheels rotatably mounted thereon.

23. An assembly as claimed in claim 22, wherein a retractable power cable is housed in the body.

* * * * *